US005766050A

United States Patent [19]

Maggi

[11] Patent Number: 5,766,050

[45] Date of Patent: Jun. 16, 1998

[54] FLIPPER AND COMBINATION OF A BOOT, SHOE, FOOTWEAR, OR SIMILAR AND A FLIPPER

[75] Inventor: Renzo Maggi, Riva Nazzano, Italy

[73] Assignee: Salvas S.p.A., Castelnuovo Scrivia (AL), Italy

[21] Appl. No.: 885,938

[22] Filed: Jun. 30, 1997

[30] Foreign Application Priority Data

Jul. 5, 1996 [IT] Italy ..... SV96A0022

[51] Int. Cl.[6] ..... A63B 31/11

[52] U.S. Cl. ..... 441/63; 441/64

[58] Field of Search ..... 441/55, 61, 62, 441/63, 64; D21/239

[56] References Cited

U.S. PATENT DOCUMENTS 5,041,039 8/1991 Chang ..... 441/64

5,108,327 4/1992 Klein ..... 441/63

5,324,219 6/1994 Beltrani et al. ..... 441/64

*Primary Examiner*—Stephen Avila

*Attorney, Agent, or Firm*—James C. Wray; Meera P. Narasimhan

[57] ABSTRACT

Fin according to the invention, with a seat (4, 22, 43) into which the foot may be introduced and wherein the walls (5, 8, 25, 41) of the seat grasp the foot at least partially, leaving out at least one area of the heel and of the ankle. The action of taking off and wearing the fin is made easier by providing that the fin (1, 21, 42), after the introduction of the foot into the seat (4, 22, 43) is automatically held back on the foot and removably connected thereto. There is also provided a combination of a fin of the aforesaid type with a type of footwear, like a boot (2), a shoe, or similar. In this case, the easier wear is due to the fact that the fin (1, 21, 42) is automatically held back on the footwear, being removably connected thereto.

21 Claims, 5 Drawing Sheets

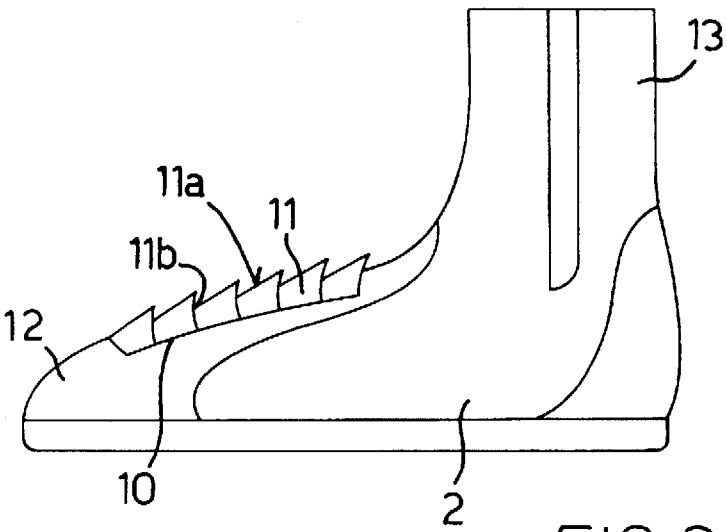
FIG. 2
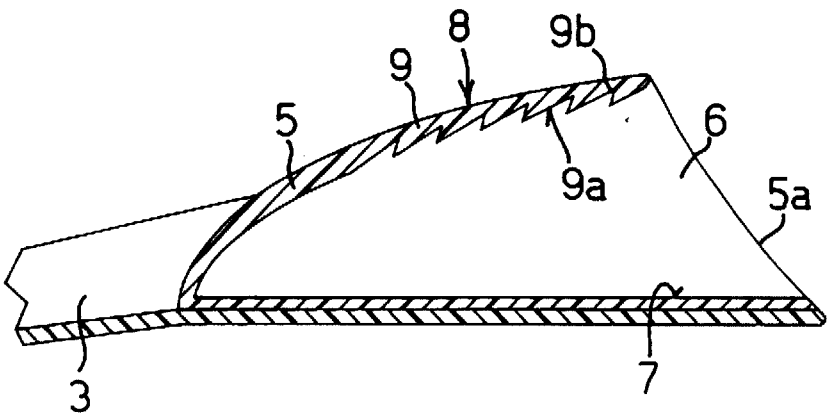
FIG. 3
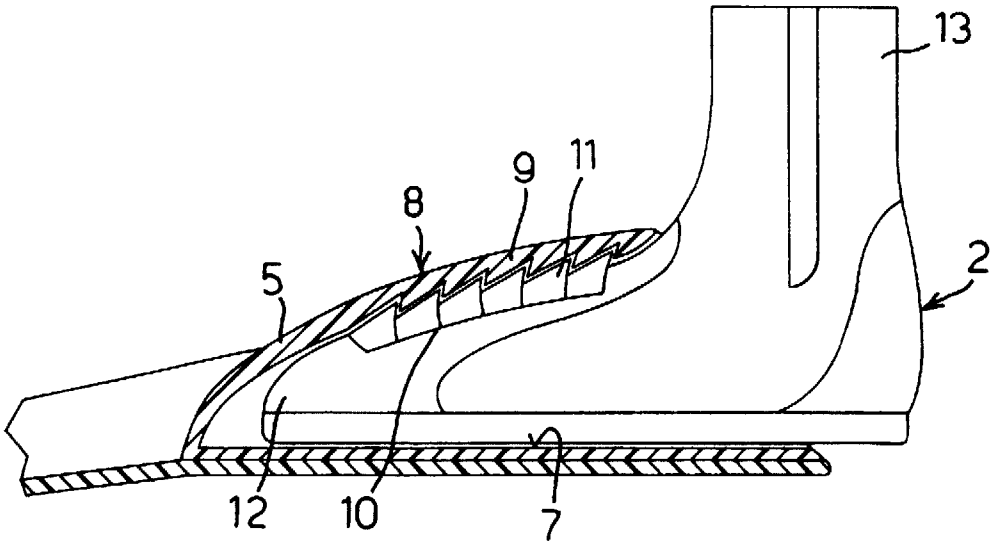

FLIPPER AND COMBINATION OF A BOOT, SHOE, FOOTWEAR, OR SIMILAR AND A FLIPPER

BACKGROUND OF THE INVENTION

The invention relates to a fin having a seat, into which the foot of the fin user may be introduced, wherein the walls of the seat grasp the foot at least partially, leaving out at least the heel and ankle area. The invention also relates to a combination composed of such a fin and of a boot, bootie, footwear, shoe, or similar, wherein the words boot or shoe in this context are intended as referring to all footwear suitable for water and underwater sports.

A large number of fins of the type described hereinbefore are currently known. They are used in sports- and professional diving, for increasing the propulsion obtained through the leg strokes of the swimmer.

Prior art fins generally consist of a fin blade and a shoe which, being integral to the fin blade, seats the foot of the swimmer. The fin blade is generally made of a thermoplastic resin, whereas the shoe is conformed to the fin blade and is made of thermoplastic rubber or of a similar material. The advantage of fins having a complete shoe-like seat for the foot of the swimmer is that the foot of the swimmer is wholly protected against skin injuries. The disadvantage of the said shoe-fins, however, is that they are uncomfortable to handle and wear. A further disadvantage of shoe-fins is that the said fins may be only fabricated to fit a predetermined foot size respectively.

In order to avoid the disadvantages of the aforementioned shoe-fins, it has been proposed to form a seat in the fin blade, the said seat being provided instead of the shoe enclosing the whole foot, and into which seat the front portion of the foot may be introduced, up to about the heel and ankle area. Through suitable means, for example, through elastic or variable-length belts, enclosing the heel, prior art fins are held back on the foot after the introduction of the latter into the seat.

The advantage of such fins, improved with respect to shoe fins is that the same fin may be worn by different people having different foot sizes, since it is possible to compensate foot size differences through length-variable harnesses.

However, the disadvantage of these improved fins is that they are uncomfortable to handle. Thus, an attempt has been made to simplify the use of the said prior art improved fins by improving the handling of harnesses and of the device for locking the harness in the desired position. Thanks to these simplifications, the fin may be worn by only using one hand substantially without problems. However, the handling of the fins improved in this way is still difficult. These difficulties are particularly evident when divers, and generally professional divers, wear diving gloves.

Moreover, the use of prior art improved fins becomes more difficult for their being worn and taken off at the beginning or at the end of the single dive, that is when the diver wears his whole diving equipment, and therefore is loaded with the burden thereof.

Finally, as prior art improved fins do not protect the heel area against injuries, it is necessary to wear swimming boots or shoes, made for example of neoprene or rubber, in order to avoid such injuries. As a result, the area in which the boot, the shoe or similar are connected to their respective blade must be made to be massive and so, when it is invested by a water current, it offers a considerable resistance to the flow.

SUMMARY OF THE INVENTION

The invention is based on the problem of simplifying the handling of the fin while taking off and wearing a fin of the type mentioned hereinbefore, and a combination consisting of such a fin and of a boot or shoe.

The invention solves the above problem by providing that the fin, after the introduction of the foot into the seat, is automatically held back on the foot and removably connected thereto.

The invention also provides that the fin is held back on the foot only by introducing the foot into the seat of the fin, so that, on the one hand, a safe restraint of the fin on the foot is ensured, and, on the other hand, a problem-free detachment of the fin from the foot is possible. This may be achieved, for example, by providing that the walls of the seat are made of a suitable, eventually elastic material, which is expanded by the foot on its introduction, still exerting a sufficient restraining force. The seat itself may be adapted to the anatomy of the front portion of the foot, in order to ensure a safe shape-matching restraint between the fin and the foot.

As for the combination consisting of a fin of the type mentioned hereinbefore and of a corresponding boot, bootie, shoe, or similar, the said problem is solved by providing that the fin, after the introduction of the boot or shoe into the seat, is automatically held back on the boot or shoe, being removably connected thereto.

As previously described for the fin, even when a boot, shoe, or similar, is used, the material for making the seat of the fins may be chosen, for example, in such a way that the walls of the seat are widened on introducing the boot or the shoe, so as to exert an elastic force thereon. This elastic force is sufficient to hold back the fin on the boot or shoe respectively. On the other hand, it is low enough as to ensure a problem-free detachment of the boot or shoe from the fin.

An advantageous embodiment of the combination according to the invention, consisting of a boot, bootie, shoe or similar and of a fin, is characterized in that the boot, bootie, shoe or similar and/or the fin have locking means which, when the boot or shoe, or similar are introduced into the seat, provide removable connection to the fin. These locking means, added to the eventual dynamic matching connection, provide a shape matching between the boot, shoe, or similar and the fin. This shape matching connection provides an increased safety of restraint between the fin and the boot, shoe or other footwear. Meanwhile, the locking means are arranged in such a way that, when the boot or shoe is introduced into the seat, they automatically fasten it to the fin.

The combination according to the invention, consisting of a boot, bootie, shoe, or similar and of a fin enables variously sized boots, shoes or similar to fit the same fin. Since boots, shoes or similar footwear are generally made of deformable elastic material, their deformation is dependent on the shape of the foot of the diver who wears them. In order to compensate the different arrangement of the locking means, caused by this deformation of the boot, shoe, or similar, the locking means associated to the seat of the fin need only be placed on a slider, whose position is removably fixable by means of a drive on the outer side of one wall of the seat. Such a slider allows to vary the position of the locking means after the introduction of the boot, shoe, or similar, into the seat, to such an extent that an optimal lock is obtained, even when the connection between the fin and the boot or shoe is insufficient. Meanwhile, a presumably simple handling is achieved, thanks to the possibility of adapting the position by simply moving the slider, from the outer side of the fin.

The previously described adaptation of the position of the locking means is particularly simple when the slider may be moved along a guide bar and locked thereon.

A possibility for a handy, easily achievable connection, between a fin and a type of footwear, like a boot or a shoe, consists in that, in the combination according to the invention, the locking means associated to the boot or shoe are made in the form of at least one single wedge-shaped element, being provided at least on one outer side of the footwear, that is of the boot or shoe, associated to the seat, the said wedge starting to open on its edge associated to the toe of the boot or shoe, whereas the locking means associated to the seat are also made in the form of at least one single wedge-shaped element, which is provided in the inner side of the corresponding wall of the seat, and whose wedge surface starts to diverge from its edge opposite to the tip of the fin. Meanwhile, an increased safety of restraint between the boot or shoe and the fin may be achieved, in such a way that on the outer side of the boot or shoe, and on the inner side of the seat respectively, several wedge-shaped elements are arranged in a row, one behind the other. This arrangement of the wedge-shaped elements in a row, one behind the other, has the additional advantage that variously sized boots or shoes may be locked without problems to the same fin respectively.

Particularly, the detachment of the fin from the boot or shoe, in the combination according to the invention, consisting of a boot or shoe and of a fin may be made easier by providing that the locking means associated to the seat may be engaged, so as to be able to move angularly, that is oscillate, in an aperture of the corresponding wall of the seat. In this case, the locking means may be respectively supported by a portion of the wall, which for its specific elastic feature, is connected to the fin so as to be able to move angularly, like a tongue. According to the modes of application, advantages may be also drawn from connecting the locking means to the fin by a particular joint.

If the locking means are connected to the fin so as to be angularly movable, a more reliable connection between the fin and the boot or shoe may be advantageously achieved by providing that the locking means may be removably locked in a mounted position which is movable angularly to the boot or shoe by means of a locking device, wherein a particularly suitable locking device for this purpose is a snap device.

The introduction of the boot or shoe into the seat of the fin may be simplified by providing that the seat is a cavity with a substantially concave conical shape, and that the front portion of the boot has an correspondingly convex conical shape. Thanks to this conformation, when the boot or shoe is introduced into the seat of the fin, it is automatically centred, and so the locking means of the boot or shoe and of the fin may engage one into the other without problems.

A combination being particularly easy to make, consisting of a boot or shoe and of a fin is characterized in that the locking means are fabricated integrally to the material of the corresponding wall of the boot or shoe, or of the seat, respectively. According to the presumed stress, it may be also advantageous to fabricate the locking means in a manufacturing step separate from the fabrication of the fin and/or of the boot, shoe, or similar and to fasten them subsequently to the fin and/or to the boot, shoe, or similar, by means of rivets, nails, heat seal, electric or ultrasonic welding, forming and/or gluing or even through removable fasteners, like the so-called Velcro, or similar. This sequence of manufacturing steps in the fabrication of the locking means and of the boots, shoes or similar, or of the fin allows to make the locking means out of materials being right for the application purpose, and having a suitable strength for the specific stresses, whereas, for the fabrication of the fins or of the boots, shoes or similar, it is also possible to choose materials being right for the purpose, such as ethyl vinyl acetate (E.V.A.), pebax or polyurethane (P.U.), which meet comfort requirements and are suitable for the functions of the fin.

According to a further characteristic, the footwear provided in combination with the fin may be formed by at least two or three different materials, in different colours. Advantageously, the footwear may also be shoes, sandals or similar, of the leisure type, particularly for a beach of bathing use. Further, the footwear may also be sports shoes, or similar.

A further variant provides that the footwear has a structure being only intended for providing coupling between the locking means and the foot.

In this case, the footwear may be in the form of a band enclosing the foot around the instep area, wherein there must be provided locking means complementary to those provided on the fin. The band may be annular, that is closed in itself and elastically lockable on the foot, or may be provided with removable means for connecting ends and for clamping, like buckles, Velcro, laces, or similar.

According to an improvement, the footwear is in the form of the so-called fin-fasteners, which consist of a band enclosing the foot in its instep area, and being meant to hold the locking means, and of an additional belt, which connects two symmetrically opposite points of the rear edge of the band which encloses the instep, like a belt designed to pass behind the ankle to restrain the instep-enclosing band even in the front-rear direction. Even in this case, the material may be elastic and the footwear may not be provided with locking means, or there may be provided buckles, or fastening means like Velcro, or similar.

The invention will be further detailed, with reference to an embodiment illustrated in the drawings, in which:

BRIEF DESCRIPTION OF THE INVENTION

FIG. 2 is a lateral partially sectional view of the fin and the boot according to FIG. 1;

FIG. 3 is a lateral, partially sectional view of the fin and the boot according to FIGS. 1 and 2 in a second position;

DETAILED DESCRIPTION OF THE PREFERRED EMBODIMENT

Figure 1:
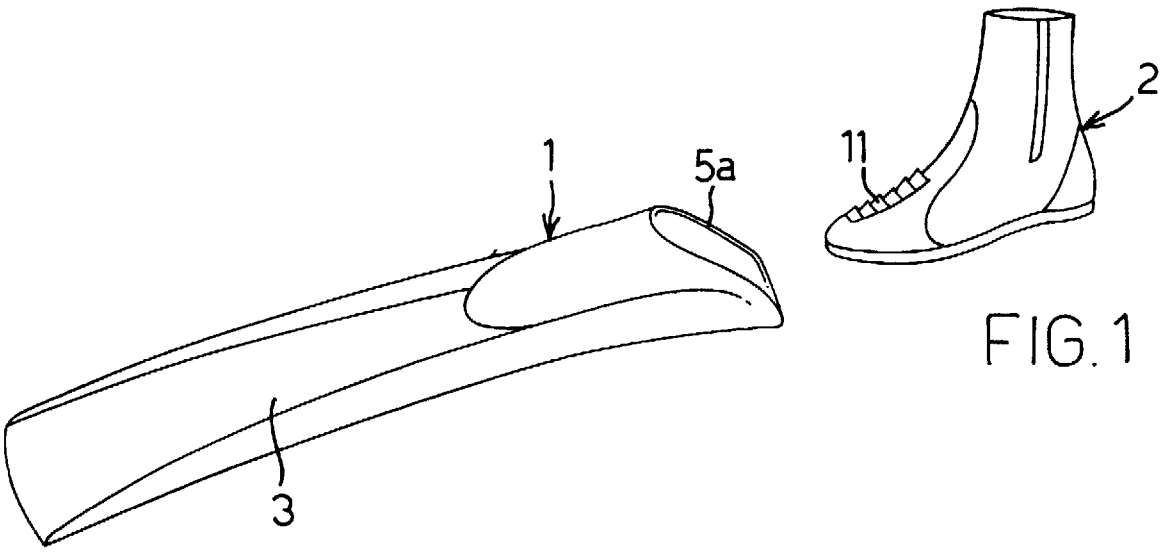
FIG. 1 is a perspective view of a fin and a boot.
Figure 4:
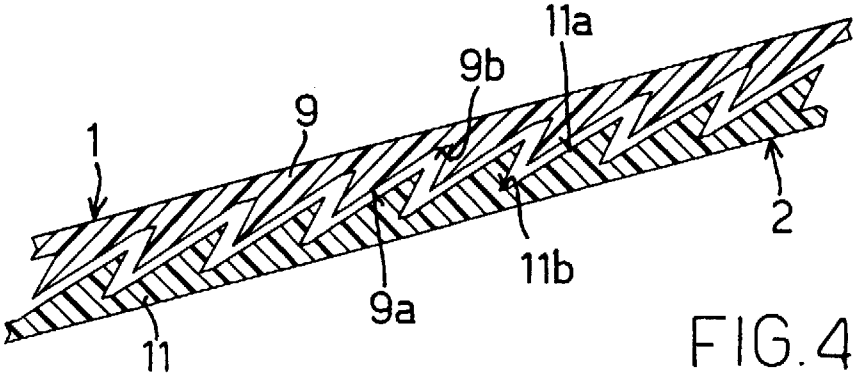
FIG. 4 is a scaled magnified view of a detail of FIG. 3.
Figure 6:
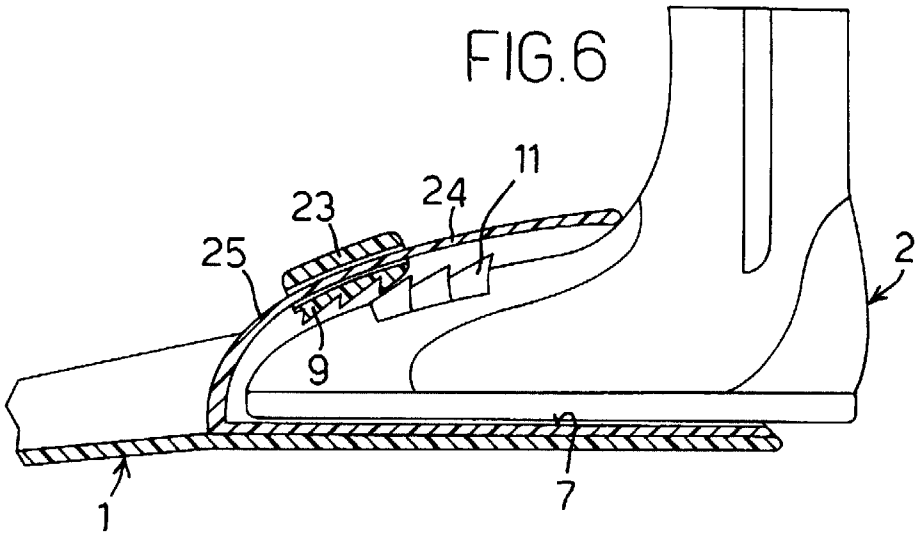
FIGS. 5 to 8 are different views of a first variant embodiment of the invention.
Figure 7:
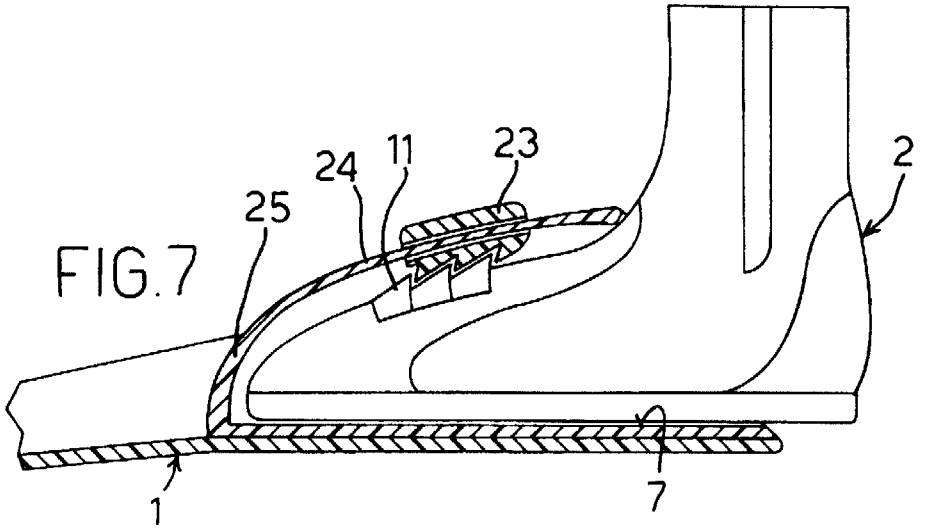
Figure 5:
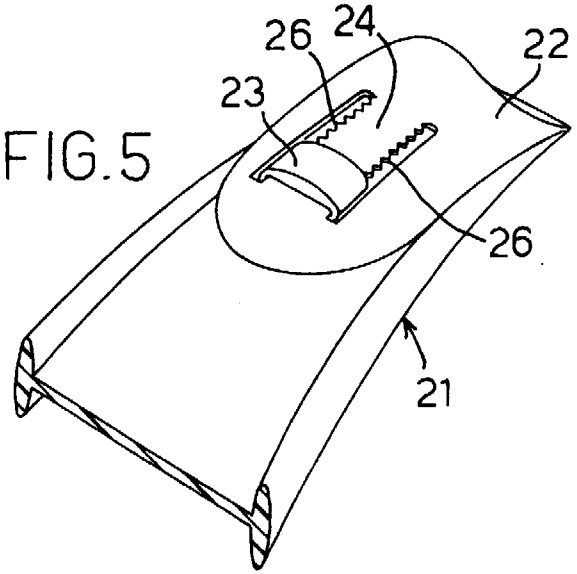
Figure 8:
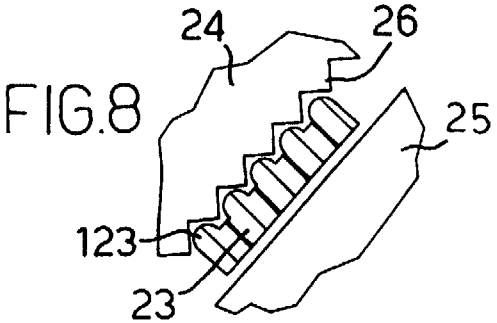

The combination consisting of a fin and of a boot comprises a fin 1 and a boot 2. The fin 1 has a fin blade 3 made of a thermoplastic material. A seat made of thermoplastic rubber, of natural rubber, of polypropylene, of polyethylene, or similar is conformed to the blade 3. The walls 5 of the seat 4 enclose the inner space 6 of the seat 4, the lateral edges 5*a*, which delimit the aperture of the inner space 6, being decreasingly inclined from the bottom 7 up to the upper wall 8. On the inner side, associated to the inner space 6, of the upper wall 8 of the seat 4, there are provided wedge-shaped elements 9, whose wedge surfaces 9*a* start to lift up from their edge 9*b*, associated to the aperture of the inner space, towards the tip of the fin, so that the wedge-shaped elements 9 have a substantially hook-shaped cross section. There is provided a certain number of these wedge-shaped elements 9, which are arranged in a row, one behind the other.

The boot 2 is substantially made of elastic neoprene or of thermoplastic rubber. On the upper side of the front portion 10 of the boot 2, there are provided wedge-shaped elements 11, made with a material which is stronger than neoprene and connected to the supporting material of the boot 2 by gluing, riveting, or conforming, or by means of removable fasteners, like the so-called Velcro or similar. The wedge-shaped elements 11 have a wedge surface 11*a* which lifts up towards the recess 13 of the boot, starting from the edge 11*b*, which faces the tip 12 of the boot, therefore the wedge elements 11 also have a substantially hook-shaped cross section. Even in this case there is provided a certain number of these wedge-shaped elements 11, which are arranged in a row, one behind the other, on the upper side of the boot.

In the case of the embodiment shown in FIG. 2, when the boot 2 is introduced into the seat 4, the elastic walls 5, 8 of the seat 4 are expanded. Meanwhile, the wedge surfaces 9*a*, 11*a* of the corresponding wedge-shaped elements 9, 11 slide one onto the other until the boot 2 reaches its final position, predetermined by the outer size of the boot and by the inner size of the inner space 6 of the seat 4. After reaching their respective final position, the wedge-shaped elements 9 of the seat 4 and the wedge-shaped elements 11 of the boot 2 mutually engage like hooks and, as a result, the boot is firmly locked to the fin 1 and the fin 1 is held back on the boot 2.

The detachment of the fin 1 from the boot 2, is obtained through the expansion of the elastic walls 5, particularly of the upper wall 8 of the seat 4. As from then, the boot 2 may be taken off from the inner space 6 of the seat 4.

In the case of the fin 21, shown in FIGS. 5 to 8, the wedge-shaped elements associated to the seat 22 are fastened to a slider 23. The slider 23 is made to slide on a guide bar 24, which is provided on the upper side 5 of the seat 22. The guide bar 24 has lateral locking protrusions 26, closely spaced, in which corresponding locking protrusions 123, provided on the sliding member 23, are engaged. By this arrangement, the slider 23 may be locked in position, without problems, and through small steps, on the guide bar 24.

When the boot 2 is introduced into the seat 22, the wedge surfaces 11 of the boot 2 slide along the wedge-shaped elements, not shown, and supported by the slider 23, as previously described for the embodiment according to FIGS. 1 to 4. When, after reaching the final position of the boot 2, the lockup of the locking elements 11 of the boot with those of the seat 22 is ascertained as non optimal, then, by moving the slider 23, the position of the wedge-shaped elements associated to the seat 22 may be accordingly varied, until a firm locking connection between the wedge-shaped elements of the seat 22 and of the boot 2 is achieved. The fine arrangement of the locking protrusions 26 of the guide bar 24 allows for a fine positioning of the slider 23.

Figure 9:
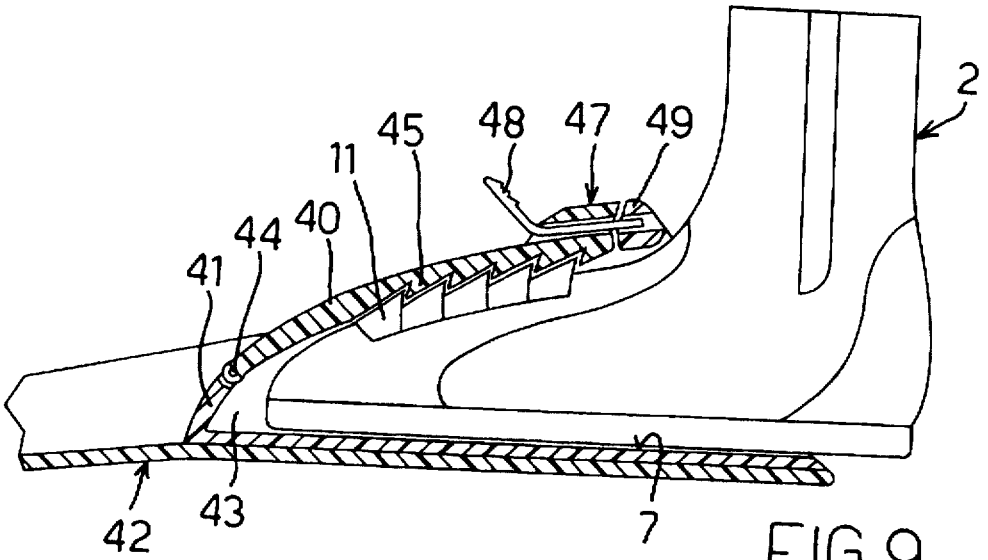
FIG. 9 is a view, corresponding to FIG. 3, of a second alternative embodiment of a fin with a boot.
Figure 10:
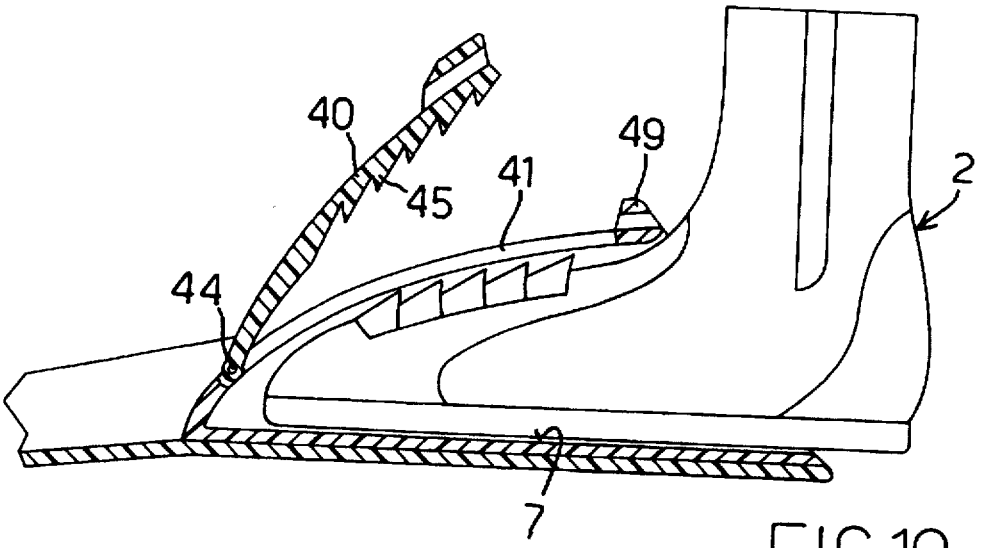
FIG. 10 shows the fin and the boot according to FIG. 9 in a second position.

In the case of the embodiment shown in FIGS. 9 and 10, a portion 40 of the upper side 41 of a seat conformed to a fin 42, is connected to the rest of the upper wall 41 of the seat 43 in such a way as to be angularly movable. To this purpose, the axis of oscillation of the oscillation joint 44 is placed substantially perpendicular to the longitudinal axis of the fin 42. The wedge-shaped elements 45 are conformed integrally to the portion 40 and their shape is made to match the shape of the previously described wedge-shaped elements 9, being also arranged in a row, one behind the other, like the wedge-shaped elements 9.

To clamp the portion 40 in its normal functional position, in which the boot 2 is locked to the fin 42, there is provided a locking device 47, in the form of a releasable snap device. The latch 48 of the locking device 47 is elastically stressed so that it automatically engages in a corresponding aperture of the fixed portion 49 of the upper side 41 of the seat 43. By pulling the latch 48, the latter may be removed from the aperture, so that the portion 40 with the wedge-shaped elements 45 may be angularly moved.

Prior to the introduction of the boot 2 into the seat 43, the seat 43 is shut by a corresponding angular motion of the portion 40. Then, the boot 2 is introduced into the seat 43, until the wedge-shaped elements 11 of the boot 2 engage with the wedge-shaped elements 45 of the portion 40, according to the method described hereinbefore for the wedge-shaped elements 9 and 11.

The detachment of the fin 42 from the boot 2, is obtained by unlocking the locking device 47, through a pull of the latch 48, so that the portion 40 provided with the wedge surfaces 45 may be angularly moved apart from the boot 2. Once the portion 40 is angularly moved apart, the boot 2 may be removed without problems from the seat 43.

Figure 11:
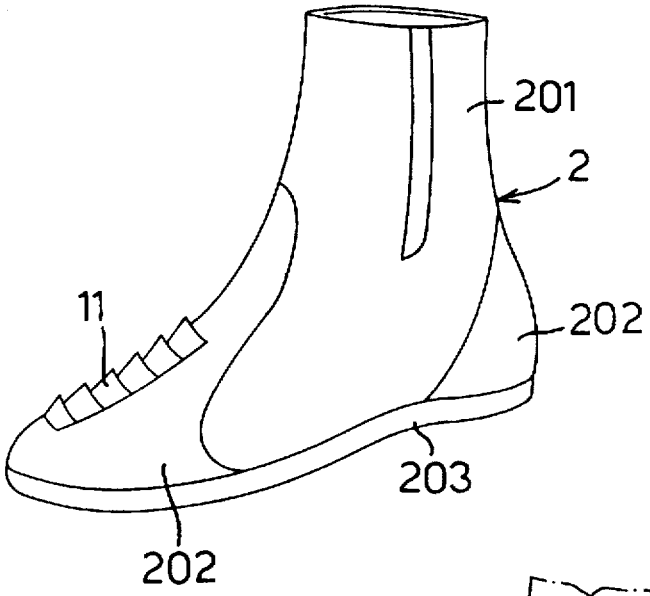
FIG. 11 is a magnified perspective view of a variant embodiment of the boot.
Figure 12:
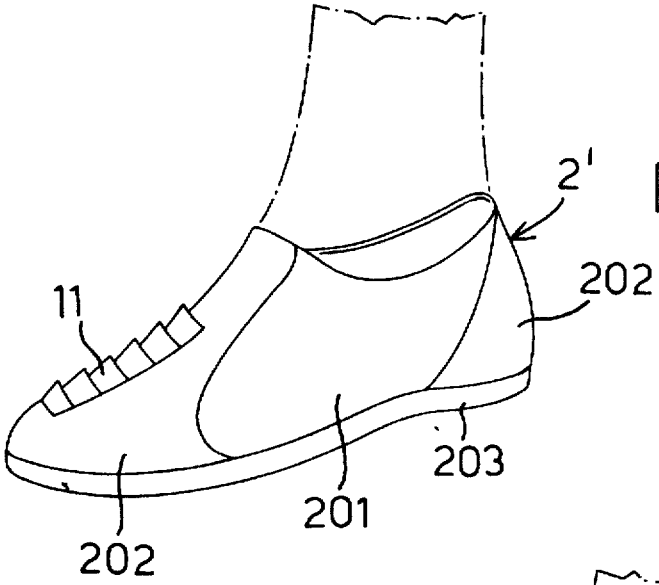
FIG. 12 is a magnified perspective view of a shoe provided in combination with the fin.
Figure 13:
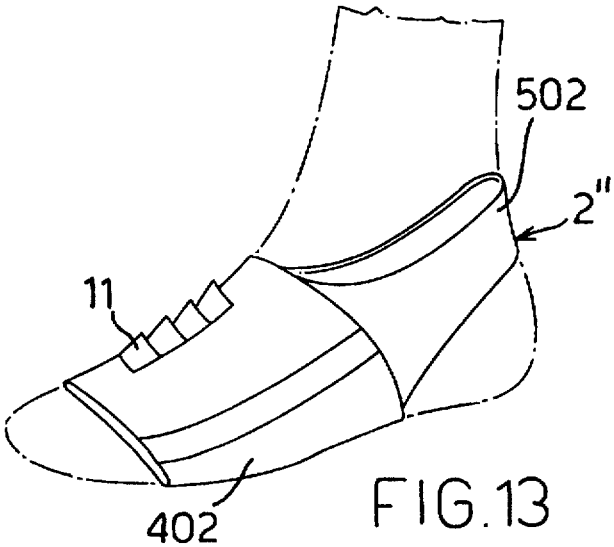
FIG. 13 is a perspective view of an alternative variant of the footwear being meant to hold the locking means associated to the foot, taking the form of a band which encloses the instep area of the foot, with a passband, which encloses the ankle from behind.

FIGS. 11 to 13 show different variant embodiments of the footwear meant to hold the wedge-shaped locking elements 11, cooperating with those 9, 45, of the seat of the fin 1. For reasons of simplicity, in FIGS. 11 to 13, the wedge-shaped locking elements 11, associated to the footwear are generally indicated by only displaying the area in which they are applied to the footwear.

FIG. 11 shows a variant embodiment of the boot, which may be made of two materials, 201, 202, one of which 201, being for example highly elastic, to facilitate wear, and the other being stiffer. Alternatively, it is also possible to differentiate the type of material of which the sole 203 is made. Moreover, the different areas may differ in colour either exclusively or in combination with the use of different materials.

In order to provide a higher comfort of use of the fin, especially in case of non-professional use, there may be provided, instead of the boot 2, a boot formed like a shoe 2', according to FIG. 12. The shoe may be either a normal sports shoe, provided in the position wherein the locking means 11 are fasted thereto, with removable means for fastening the wedge-shaped locking means 11 thereto, like, for example a strip of Velcro, or similar, or a bathing or beach sandal, or may be made like a boot for professional use, that is of more materials in different areas 201, 202, 103, including neoprene.

FIG. 13 shows a variant embodiment in which the footwear 2"is in the form of a so-called fin-fastener and comprises at least one band 402, intended to be fastened to the foot, by enclosing it in the instep area corresponding to the fastening area of the locking means 11. The band may be elastic and closed in itself, or may be made in the form of a ribbon, provided with locking and clamping means, like buckles, or like Velcro, or similar.

According to an improvement, the band 402 may also have a passband being meant to enclose from behind the ankle area. The passband 502, having the form of a belt, may also be elastic and stably fastened in symmetrically opposite areas of the rear edge of the band 402, or may be provided, at least at one end, with means for fastening and/or clamping to the band 402, also in the form of buckles, Velcro, or similar.

By providing a sole, fastened for example to the portion of the band passing on the foot sole, the footwear obtained may be in the form of a slipper, or a sandal.

Naturally, the invention is not limited to the embodiments disclosed and illustrated herein, but may be greatly varied, especially as regards construction, without departure from the scope disclosed above and claimed below.

I claim:

1. Fin having a seat (4, 22, 43) into which the foot of the user of the fin (1, 21, 42) may be introduced, and wherein the walls (5, 8, 25, 41) of the seat (4, 22, 43) grasp the foot at least partially, leaving out at least the heel and ankle area, characterized in that the seat of the fin grasps only the front portion of the foot and that the fin is automatically held back on the foot and removably connected thereto, after the introduction of the front portion of the foot into the seat, due to a widening of the seat, occurring when the foot is introduced into the seat and/or to a shape-matching connection which is automatically established when introducing the foot into the seat.

2. Combination as claimed in claim 1, characterized in that the fin (1, 21, 42) is substantially made of an elastic material at least in the area of the seat (4, 22, 43).

3. Combination as claimed in claim 1, characterized in that the footwear (2) may be in the form of sports shoes (2'), provided with integral or stably fastened locking means (11) or provided with removable means for fastening the said locking means (11) thereto.

4. Combination as claimed in claim 1, characterized in that the shoe or boot are made of at least two, preferably three materials (201, 202, 203), differing as regards stiffness, elasticity and/or colour.

5. Combination as claimed in claim 4, characterized in that the areas made of different materials (102, 202, 302) are distributed in such a way as to ensure the highest mechanical strength and ease of wear.

6. Combination as claimed in claim 1, characterized in that the footwear (2) consists in beach or bathing footwear, such as a sandal or similar.

7. Combination as claimed in claim 1, characterized in that the footwear (2) is in the form of a band (402) enclosing the foot around the instep area, which is designed to hold the locking means (11).

8. Combination as claimed in claim 7, characterized in that the band may be of the annular and elastic type, so as to close the foot therein, or in the form of a ribbon provided, at its opposite ends, with means for fastening the latter and/or for clamping the band around the foot, like buckles or Velcro.

9. Combination as claimed in claim 7, characterized in that the band (402) may be provided with an additional belt (502), which connects two symmetrically opposite points of the rear edge of the band (402) which encloses the instep, and which is designed to pass behind the ankle to restrain the instep-enclosing band (402) even in the front-rear direction.

10. Combination as claimed in claim 9, characterized in that the belt (502) which encloses the ankle may be made of an elastic material and be either stably fastened to the band (402) with its two opposite ends, or removably fastened and clamped to the band (402) which encloses the foot instep by fastening and clamping means like buckles, Velcro, or similar.

11. Combination consisting of a boot (2) or shoe and of a fin (1, 21, 42) having a seat (4, 22, 43) into which the boot (2) or shoe may be introduced, whereas the walls (5, 8, 25, 41) of the seat (4, 22, 43) enclose the foot portion of the boot (2) or shoe at least partially, leaving out at least its heel and ankle area, and wherein the fin (1, 21, 42), after the introduction of the boot (2) or shoe into the seat (4, 22, 43), is automatically held back on the boot (2) and removably connected thereto, characterized in that the boot (2) or shoe and/or the fin (1, 21, 42) have locking means (9, 11, 45) which, when the boot (2) or shoe is introduced into the seat (4, 22, 43), connect it to the fin (1, 21, 42), in that the locking means (11), associated to the boot (2) or shoe, are made in the form of at least one single wedge-shaped element (11), being provided at least on one outer side associated to the seat (4, 22, 43), and whose inclined wedge surface (**9*a*) starts to lift up on its edge (9*a*) associated to the toe (12) of the boot or shoe, and in that the locking means (11) associated to the seat (4, 22, 43) are made in the form of at least one single wedge-shaped element (9), which is provided in the inner side of the corresponding wall (8, 41) of the seat (4, 22, 43), and whose inclined wedge surface (9*a*) starts to lift up from its edge (9*b*) opposite to the tip of the fin (1, 21, 42**).

12. Combination as claimed in claim 11, characterized in that the locking means (9, 11, 45), associated to the seat (4, 22, 43) of the fin (1, 21, 42) are placed on a sliding member (23), whose position is removably fixable, the slider being driven from the outer side of one of the walls (5, 8, 25, 41) of the seat (4, 22, 43).

13. Combination as claimed in claim 12, characterized in that the sliding member (23) may slide along a guide bar (24) and be locked in position thereon.

14. Combination as claimed in claim 11, characterized in that on the outer side of the boot (2) or shoe, and on the inner side of the seat (4, 22, 43) respectively, several wedge-shaped elements (9, 11, 45) are arranged in a row, one behind the other.

15. Combination as claimed in claim 11, characterized in that the locking means (11), associated to the seat (4, 22, 43) are placed inside an aperture of the corresponding wall (41) of the seat (4, 22, 43).

16. Combination as claimed in claim 15, characterized in that the locking means (11) are provided in one portion (40) of the wall of the seat, which is provided with an articulated connection to the fin (1, 21, 42).

17. Combination as claimed in claim 15, characterized in that the locking means (11) may be removably locked by means of a locking device (47), in their overturned position against the boot or shoe (2).

18. Combination as claimed in claim 17, characterized in that the locking device (47) is made in the form of a snap device.

19. Combination as claimed in claim 11, characterized in that the seat (4, 22, 43) has a substantially concave hollow inner space (6) with a conical shape, and the front portion (10) of the boot (2) or shoe has a correspondingly convex conical shape.

20. Combination as claimed of claim 11, characterized in that the locking means (11) are made to be integral to the corresponding wall of the boot (2) or shoe, or of the fin (1, 21, 42).

21. Combination as claimed in claim 11, characterized in that the locking means (11) are fabricated in a manufacturing step separate from the fabrication of the fin (1, 21, 42) and/or of the boot (2) or shoe and subsequently fastened to the fin (1, 21, 42) or to the boot (2) or shoe by means of rivets, nails, heat seal, electric or ultrasonic welding, conforming and/or gluing or through removable fasteners, such as Velcro, or similar.

* * * * *